US005279405A

United States Patent [19]

Petter

[11] Patent Number: 5,279,405

[45] Date of Patent: Jan. 18, 1994

[54] GUARD FOR OPERATOR OF PALLETIZED LOADS

[75] Inventor: Jay C. Petter, Pentwater, Mich.

[73] Assignee: Pentwater Wire Products, Inc., Pentwater, Mich.

[21] Appl. No.: 950,901

[22] Filed: Sep. 24, 1992

Related U.S. Application Data

[63] Continuation-in-part of Ser. No. 709,595, Jun. 3, 1991, Pat. No. 5,220,980.

[51] Int. Cl.[5] ..... B66B 9/20

[52] U.S. Cl. ..... 187/9 R; 414/785

[58] Field of Search ..... 187/9.R, 9.E; 414/785, 629, 414/630, 631, 608

[56] References Cited

U.S. PATENT DOCUMENTS 3,791,544 2/1974 Moses ..... 414/785

4,808,060 2/1989 Wasylyshyn ..... 414/785

*Primary Examiner*—D. Glenn Dayoan

*Assistant Examiner*—Kenneth Noland

*Attorney, Agent, or Firm*—Price, Heneveld, Cooper, DeWitt & Litton

[57] ABSTRACT

The invention provides a guard for warehouse personnel which guard is designed to be secured to a pallet and remain with the pallet both when the pallet is being transported and when it and its load are stored on racks in a warehouse. Thus, the guard remains with the pallet at all times to prevent the load on the pallet falling on personnel in an adjacent aisle. The guard can be separated from the pallet only as the result of intentional release by warehouse personnel.

15 Claims, 2 Drawing Sheets

GUARD FOR OPERATOR OF PALLETIZED LOADS

This application is a continuation-in-part of my application Ser. No. 709,595, entitled IMPROVED GUARD FOR OPERATOR OF PALLETIZED LOADS, filed Jun. 3, 1991 now U.S. Pat. No. 5,220,980.

BRIEF SUMMARY OF THE INVENTION

It provides a simplification without loss of function or strength of the operator guard disclosed in the abovementioned application. As such, it is an accessory to be used in warehouses employing vertical stacking of palletized loads which loads are of a type which might become unstable and fall into the adjacent aisle or on the operator while storing or removing them from multi-tier rack storage or on others using the adjacent access aisle. An L-shaped screen is provided, one leg of which is secured to the load supporting pallet and the other leg is a vertical panel positioned between operator and the load to serve as a means of preventing any of the pallet's load falling in the direction of the operator or into the aisle while the pallet is being elevated and retrieved during the period the pallet and its load remain in storage.

BACKGROUND OF THE INVENTION

As the use of palletized warehousing expands and the cost of land and warehouse facilities increases, the response has been to use higher and higher storage racks. This conserves floor space, but increases the risk of serious injury to personnel. Anything that can contribute to unbalancing of the load on the pallet can contribute to the load's instability, such as uneven settling of the load or vibration of the warehouse structure. These can be caused by external forces such as exterior traffic or nearby construction. As a result, the once vertically stacked load with adequate uniformity of weight distribution becomes unbalanced and starts to incline to the front or the back or to one side. Once this starts, the shift can be progressive, with increasing instability of the load. Another source of pallet load instability is that of personnel placing heavy articles on top of light ones, so packaged that they are unable to maintain their geometry when subject to such compressive loads. If this instability happens to be toward the warehouse aisle and the load becomes unstable and falls, the result could be serious to those in the aisle below.

BRIEF DESCRIPTION OF THE INVENTION

The invention provides a lightweight, article engaging and retaining screen of simplified construction between the lift truck operator and the load on the pallet. This screen is secured to the pallet and remains with the pallet both when the pallet is loaded and when it is empty. It is always between the load and the forklift operator during elevation and retrieval of the loaded pallet and is always between the load and personnel in the adjacent aisle when the loaded pallets are in the storage racks.

DESCRIPTION OF THE PREFERRED EMBODIMENT

Figure 3:
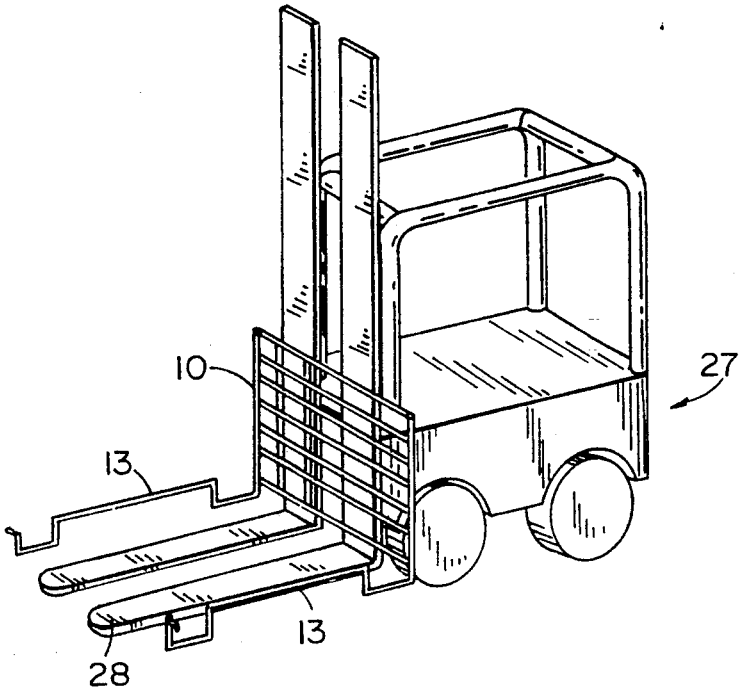
FIG. 3 is a view similar to FIG. 2 when the guard is engaged by a forklift truck and no pallet is present.
Figure 1:
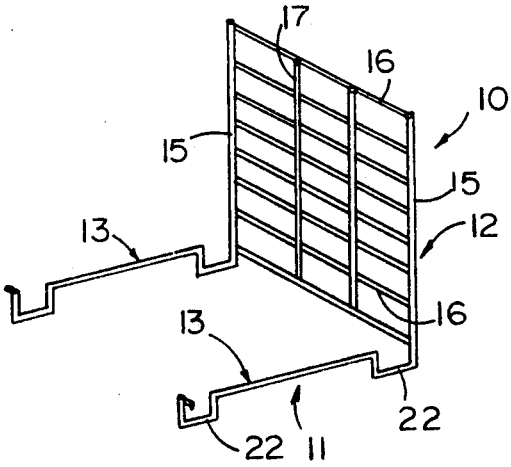
FIG. 1 is an oblique view of the personnel guard for a pallet.

Referring to FIG. 1, the numeral 10 identifies a pallet guard designed to protect personnel from injury due to slippage and unintentional discharge of articles toward the lift operator from the pallet to which the guard is attached. The pallet guard has a base portion 11 and an integral upstanding screen portion 12 (FIG. 1). Common to both the base and screen portions are a pair of spaced frame members 13, one leg of each of which extends horizontally forming the base portion and the other leg extends vertically forming the vertical or screen portion of the frame members. The vertically extending portions 15 of the frame members 13 are connected by horizontal rods 16. The rods 16 are arranged at vertical intervals or spacings such that the articles which are normally stored and transported on the pallet 20 (FIG. 2) cannot slide between them and thus escape from the pallet. A normal spacing for the rods 16 would be about two and one-fourth inches.

The center of the screen formed by the rods 16 can be reinforced by a pair of stiffener rods 17 which extend only between the top and bottom ones of the rods 16. The frame members 13, and preferably the stiffener rods 17, are of substantially greater diameter than the horizontal rods 16 because they must resist deflection as a result of the articles on the pallet becoming displaced and exerting a heavy load acting rearwardly against them. Thus, for example, the frame members 13 can be formed from rod of one-half inch diameter while the horizontal rods 16 can be of rod of one-fourth inch diameter.

Figure 5:
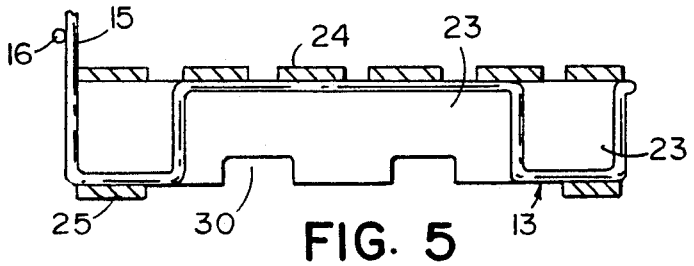
FIG. 5 is a sectional elevation view taken along the plane V—V of FIG. 4.
Figure 6:
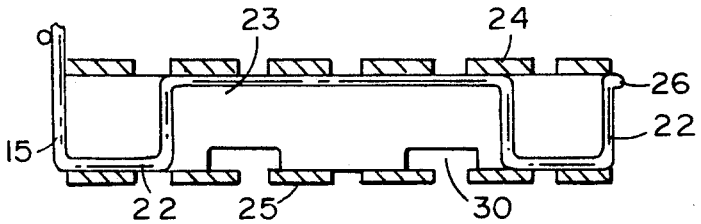
FIG. 6 is a sectional elevation view taken along the same plane as FIG. 5, illustrating a modified construction for the pallet.
Figure 7:
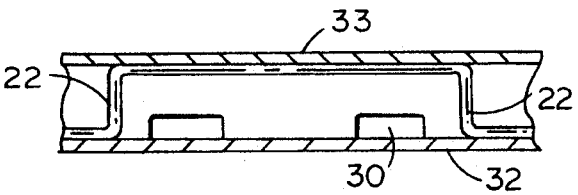
FIG. 7 is a fragmentary sectional view taken along the same plane as FIG. 5, illustrating a modified construction for the pallet.

The horizontal leg of each of the frame members 13 has a pair of downwardly offset portions 22, one next to the screen 12 and the other adjacent the other end of each of the legs. The height of the offset portions 22 is approximately equal to the vertical height of the legs 23 of the pallet 20 to which the pallet guard 10 will be attached (FIGS. 4, 5, 6 and 7). Thus, the offset portions 22 will almost completely span the vertical distance between the load supporting top panel or boards 24 of the pallet and the pallet's base or bottom boards 25. The portions of the legs 14 between the offset portions will seat immediately beneath the top boards 24 while the bottoms of the offset portions will seat against or be spaced only a fraction of an inch from the top surfaces of base or bottom boards 25 when the pallet and guard are being transported by a forklift truck 27. When the pallet is being transported, as by the tines 28 of a forklift truck, the bottoms of the offset portions 22 will rest on the bottom boards 25. Thus, whether the pallet rests on a floor or rack or is being transported or elevated by the tines of a forklift truck, the pallet guard will be positively held by the pallet and any forces acting against the upstanding screen portion 12 will be effectively resisted by the pallet and the weight it is supporting. This result is the same whether the tines of the forklift are inserted parallel to the pallet legs 23 or from the side of the guard through the tine openings 30 in the lower portion of the legs 23 (FIGS. 5, 6 and 7).

Figure 4:
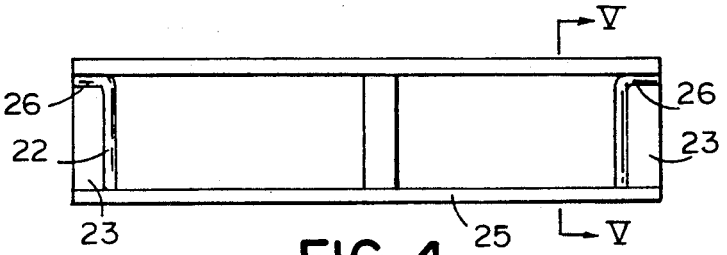
FIG. 4 is a front elevation view of the assembled pallet and personnel guard.

Irrespective of whether the pallet and screen are lifted from the screened side of the pallet guard or from one of the other sides, the pallet guard 10 is positively locked to the pallet because the ends 26 of the legs are turned outwardly away from each other to engage the front ends of pallet legs 23, thereby positively locking the pallet guard 10 to the pallet 20 (FIG. 4). While it is intended that the pallet guard, once mounted on a pallet, will remain permanently with that pallet, there are reasons why the two should be separated, such for example, as for repair of one or the other. Another would be for long-term storage during non-use. Separation would greatly facilitate compact storage.

Since the frame of the pallet guard of this construction is positively locked to the pallet but does not itself enter into any of the lifting or maneuvering of the pallet, it does not have to have any cross members to positively hold apart the horizontal portions of the frame members 13. The resilience of the legs 14 will keep the outwardly turned ends 26 firmly engaged with the front ends of the pallet legs. Thus, with one operator maneuvering the forklift truck, another is required to spring the ends of the legs inwardly sufficiently to allow the offset portions to be withdrawn lengthwise of the pallet legs. Thus, only by intentional, positive intervention can the pallet guard be separated from the pallet. This can be done by the forklift operator alone by use of a length of cord or chain with a hook on each end which can be temporarily secured to the legs of the frame next to the out-turned ends 26 to bend them so their out-turned ends will pass between the pallet legs 23. This same means can be used to assemble the guard to the pallet. In either case, the arrangement greatly simplifies and expedites both assembly and disassembly of the pallet guards and the pallets. It also significantly reduces the cost of the overall assembly. In addition, it provides a pallet guard the operator can depend upon to be positively so secured to the pallet that it will be in a position and a condition to protect him should such become necessary.

Figure 2:
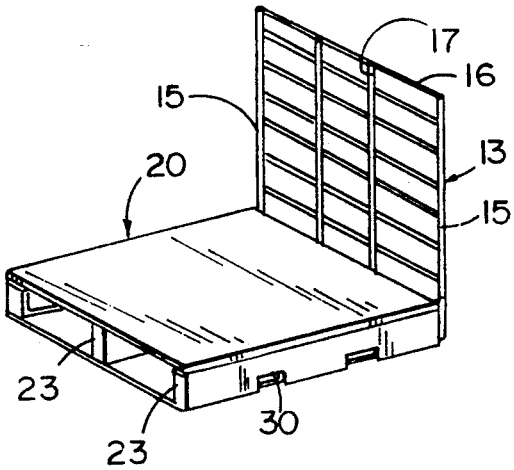
FIG. 2 is a view similar to FIG. 1 after the pallet and personnel guard have been assembled.

Whether the cargo or top surface of the pallet is constructed of spaced boards or cross members 24, as illustrated in FIGS. 5 and 6, or of a solid panel 33, such as one of veneer as illustrated in FIGS. 2 and 7, is irrelevant to this invention, since the invention works with either construction. Also, whether the openings 30 for the forks of a forklift truck are open at the bottom, as illustrated in FIG. 5, or closed or partially closed at the bottom of the legs 23, as illustrated in FIGS. 6 and 7, is also irrelevant to the invention. The necessity for positively holding the pallet against tipping during manipulation by a forklift truck does not arise while the pallet is engaged from either the ends or sides. Engagement of the pallet from the side is used only while the pallet is being moved along the aisles of the warehouse and thus normally is elevated only sufficiently to clear the warehouse floor. This does not endanger the operator. Should the use of the pallet dictate otherwise, the bottoms of the openings 30 can be closed by a panel 32, as shown in FIG. 7.

Figure 8:
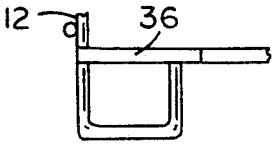
FIG. 8 is a fragmentary side elevation view of a modified construction for the pallet guard.

FIG. 8 illustrates a modified construction for the personnel guard wherein the horizontal and vertical portions of the frame members are further connected by a reinforcement member 36 which is welded to both the horizontal and vertical portions of the frame members. This, in effect, provides a high strength brace bridging the otherwise open top of the offset portion 22 where the base and screen portions join. This eliminates the tendency of the screen portion 12 to bend outwardly about the bottom of the dependent offset portion 22. The reinforcement members 36 are mounted against and welded to the exterior face of the frame member to avoid interference with the legs 23 of the pallet.

While a preferred embodiment of this invention has been described, it will be recognized that modifications of it can be made without departing from the principles of the invention. Such modifications are to be considered as included in the hereinafter appended claims unless these claims, by their language clearly state otherwise.

I claim:

1. An article intercepting and retaining guard adapted to be secured to a pallet having a pair of spaced legs and vertically spaced top and bottom cross members connecting said legs, said guard having an L-shaped body with a vertical portion and a horizontal portion, the vertical portion of which forms a personnel guarding screen extending upwardly above the cargo surface of the pallet, said horizontal portion having a pair of frame members so spaced that each can extend through a pallet from one end to the other with each one positioned closely adjacent the inside surface of a different one of the legs of the pallet, means at the end of each of said frame members opposite from said screen extending laterally in front of the end of the adjacent one of the legs to prevent withdrawal of the frame members lengthwise of said legs, a major portion of each of said legs positioned to seat against the lower face of the top ones of said cross members, said horizontal portions of said members each having a downwardly offset portion adapted to seat on the upper surface of the bottom cross member and hold said major portion of said horizontal members in or substantially in engagement with the lower surface of the upper ones of said cross members.

2. An article intercepting and holding guard adapted to be secured to a load carrying pallet having a pair of depending legs, one adjacent each side of the pallet and spaced to receive the forks of a forklift truck between them, said guard having a vertical portion and a horizontal portion forming an L-shaped body, said pallet having rigid transverse means forming an article supporting top surface and connecting said legs and also at least a pair of rigid transverse base members secured to and connecting said legs, one adjacent each end of said legs, said guard having a pair of frame members each having integral vertical and horizontal portions with said horizontal portions spaced apart substantially the spacing between the inside surfaces of said legs, each of said horizontal portions having vertically offset sections, one adjacent the vertical portion of said guard and the other adjacent the other end of each of said horizontal portions, the height of said offset portions being such that they can be slidably seated between said transverse elements and said transverse base members and extend to the ends of said legs to secure said guard to said pallet, locking means engaging the pallet for holding said guard against disengagement from the pallet by being withdrawn from between said legs.

3. The article intercepting and holding guard described in claim 2 wherein said locking means are a pair of oppositely extending fingers, one on the end of each of said horizontal portions and extending in front of and closely adjacent to the end of the pallet legs opposite from said vertical portion.

4. The article intercepting and holding guard described in claim 3 wherein said horizontal portions are capable of being forcibly flexed sufficiently toward each other to displace said fingers from in front of said pallet legs to permit said horizontal portions to be withdrawn from the pallet lengthwise of said pallet legs.

5. The article intercepting and holding guard described in claim 4 wherein means are provided for temporarily holding said fingers in said forcibly flexed convergent position.

6. A guard for the operator of a vehicle having tines used to transport and elevate loaded pallets into and out of vertically tiered storage spaces, said pallets having a cargo supporting top surface, a pair of rigid, parallel spaced beams secured to said top surface and cross members extending between and connecting the bottom surfaces of said beams, an L-shaped guard frame having rigidly connected vertical and horizontal portions with said horizontal portion thereof being of a length to extend the length of a pallet and said horizontal portions spaced to fit between and one with each portion closely adjacent each of said beams, each of said horizontal portions having downwardly extending leg portions adjacent each end thereof forming vertical spacers of a height substantially equal to the vertical spacing between said members and cross members to hold a pallet with its cargo supporting surface substantially parallel to said tines while the pallet is being transported or elevated or lowered by the vehicle into and out of storage, means for preventing the pallet from disengaging said frame.

7. A guard as described in claim 6 wherein the free ends of said horizontal portions extend laterally of said pallet in front of said beams to prevent withdrawal of said guard frame lengthwise of said leg members.

8. A guard as described in claim 7 wherein said horizontal legs are capable of being forcibly flexed enough to permit said laterally extending ends to be withdrawn lengthwise of said beams.

9. A guard as described in claim 6 wherein said horizontal portions each have downwardly offset spacer portions of a height substantially equal to the vertical height of said beams, said spacer portions being adjacent each end of each of said horizontal portions for holding the horizontal portion of said frame parallel with said cargo supporting surface of a pallet engaged by said guard with the vertical portion extending vertically upwardly therefrom.

10. A guard as described in claim 9 wherein said downwardly offset spacer portions adjacent said upright portion of said guard are each bridged by a rigid tension resistant member in substantially the same plane as the top horizontal portion of said leg members to strengthen the connection between said vertical and horizontal portions of said guard.

11. A guard as described in claim 10 wherein said tension resistant members are secured to the outwardly facing surfaces of said frame members.

12. A guard as described in claim 11 wherein said tension resistant members are welded to said frame members.

13. The guard as described in claim 6 wherein said vertical portion of said frame has cargo engaging elements extending generally horizontally therebetween, so spaced as to prevent any of the cargo on the pallet being released from the pallet by passing between said elements.

14. The guard described in claim 13 wherein a plurality of vertical members are provided in spaced generally parallel relationship to each other between said vertical portions of said guard frame, said vertical members being welded to said horizontal elements to provide a deflection resistant restraint against release of dislocated cargo.

15. The guard described in claim 14 wherein the grid formed by said vertical and horizontal members extends above the pallet at least as high as the stack of cargo to be mounted, transported and stored on the pallet.

* * * * *